United States Patent [19]

Pinkham

[11] Patent Number: 4,516,585

[45] Date of Patent: May 14, 1985

[54] METHOD AND APPARATUS FOR PRODUCING A MULTIPLE-BLEND CIGARETTE

[75] Inventor: Jesse R. Pinkham, Winston-Salem, N.C.

[73] Assignee: R. J. Reynolds Tobacco Company, Winston-Salem, N.C.

[21] Appl. No.: 415,193

[22] Filed: Sep. 2, 1982

[51] Int. Cl.[3] ..... A24C 5/18

[52] U.S. Cl. ..... 131/84.3; 131/906; 131/84.4; 131/84.1

[58] Field of Search ..... 131/84 R, 84 B, 84 C, 131/108, 364, 906; 493/4

[56] References Cited

U.S. PATENT DOCUMENTS

| | | | |
|---|---|---|---|
| 3,277,897 | 10/1966 | Gamberini | 131/84 B |
| 3,297,040 | 1/1967 | Gamberini | 131/84 C |
| 3,736,941 | 6/1973 | Molins et al. | 131/84 C |
| 3,795,249 | 3/1974 | Cristiani | 131/84 C |
| 3,854,486 | 12/1974 | Molins et al. | 131/84 C |
| 3,880,171 | 4/1975 | Naylor | 131/84 C |
| 4,009,722 | 3/1977 | Wahle et al. | 131/84 C |
| 4,196,740 | 4/1980 | Rudszinat | 131/84 C |

*Primary Examiner*—V. Millin
*Assistant Examiner*—H. Macey
*Attorney, Agent, or Firm*—Grover M. Myers

[57] ABSTRACT

A method of manufacturing a multi-blend segmented cigarette by providing a first blend of tobacco to an appropriate point adjacent to a tobacco conveying belt of a conventional cigarette making machine. A transfer wheel apparatus is utilized to form a plurality of spaced portions of the first blend and transferring the formed portions from the first blend supply to the conveyor belt, depositing the portions on said conveyor belt at spaced intervals. A second blend is delivered to the tobacco conveying belt and fills the gaps or intervals while also covering the formed portions to produce a multi-blend segmented layer. The multi-blend segmented layer is trimmed to remove only a portion of said second blend, thereby providing a layer of a uniformed thickness. The trimmed uniformed layer is transferred to a tobacco rod forming device which forms a continuously wrapped tobacco rod. The continuously wrapped rod is then cut in the interval between each of the portions and at approximately the midpoint of each portion to form single cigarette tobacco rods.

1 Claim, 10 Drawing Figures

METHOD AND APPARATUS FOR PRODUCING A MULTIPLE-BLEND CIGARETTE

BACKGROUND OF THE INVENTION

Broadly, the present invention relates to multi-blend segmented smoking products having two or more zones or segments which are generally in a spaced longitudinal relationship within an elongated rod, the segments being composed of different types of tobacco or tobacco substitute material. More particularly, the invention relates to a method and apparatus for making such segmented smoking products.

The tobacco industry long has recognized the potential value of a product containing more than one tobacco blend or tobacco substitute composition in separate locations within the tobacco rod. Despite this recognition of the desirability of such a product, however, the tobacco industry, as well as its machinery supplies, have failed in devising a practical solution to the problem of high-speed manufacturing of a segmented product. The multi-blend segmented cigarette as used herein generally refers to a single-length cigarette having only a first blend located at one end of the cigarette and a combination of the first blend and a second blend at the other end.

The art is replete with ideas for products containing more than one tobacco blend or composition. For example, British Pat. No. 250,063, issued in 1926, proposes a cigarette having more than two segments composed of tobaccos of varying strength gradations. However, no suggestions are given concerning adaptation of this idea to cigarette manufacturing techniques. Not only different blends of tobacco, but also tobacco substitute compositions lend themselves to this concept.

U.S. Pat. No. 3,902,504 discloses an "engineered cigarette" wherein rods are manufactured containing varying quantities of tobacco and tobacco substitute. The rods are wrapped and cut into segments, and then segments are arranged in a preselected pattern and joined by an overwrap to produce a segmented cigarette. In contrast to the present state of the art in high-speed cigarette manufacturing, the complexities introduced in this process would be prohibitive, bearing in mind the necessity to produce a marketable product.

U.S. Pat. No. 3,759,267 discloses a cigarette having two portions, one of natural tobacco and the other of a different type of tobacco or tobacco substitute, arranged as adjoining wedges, which is similar though not the same as a product manufactured by the method and apparatus of the present invention. However, the method for manufacturing this cigarette which is disclosed in U.S. Pat. No. 3,880,171 illustrates the great difficulty in manufacturing a product of this type. The apparatus disclosed in the patent differs radically from conventional cigarette making equipment, requiring specialized trimming and cutting apparatus to remove portions of the first blend carried on a perforated conveying belt. Furthermore, this apparatus attempts to separate the tobacco rod into sections by a blow-off unit which removes tobacco between double-length sections with puffs of air. Such a method does not easily lend itself to operation at production speeds in the range of 4,000 cigarettes per minute.

The tobacco industry and its machine suppliers have attempted to solve the cognate problem of creating the so-called "dense end," an area of increased density at the end of a cigarette to prevent tobacco from falling out, in a number of ways containing various individual elements of the type used in the present invention. However, the method in which these brown elements are used in the present invention and their relationship to one another differs greatly from the "dense end" systems. For example, U.S. Pat. No. 3,146,780 discloses a device with a tobacco conveying belt which receives a blend of tobacco from a hopper feed and a metering device which desposits additional amounts of the same blend on the continuously moving belt in response to variation in the rod density. U.S. Pat. No. 3,795,249 illustrates an apparatus for adding a portion of the same blend to the conveyor tape at specified locations prior to depositing the majority of the blend and cutting the form rod so that the added portions are coincident with each end of a single cigarette. Each of these techniques uses only a single blend and does not produce a multi-blend segmented product having a single blend at at least one end and a multi-blend at the other.

SUMMARY OF THE INVENTION

An object of this invention is to provide a method for producing a segmented multi-blend cigarette with longitudinally positioned zones or segments composed of different tobacco blends, reconstituted tobacco, or tobacco substitute compositions.

Another object of this invention is to provide a method of producing a cigarette with multiple blends wherein a single blend forms one end of the cigarette and the other end includes a combination of blends, or tobacco substitutes, etc.

Still another object of this invention is to provide an apparatus that will enable the manufacturing of segmented multi-blend cigarettes at present-day production speeds.

A further object of this invention is to provide a segmented cigarette making apparatus which is readily adaptable to conventional cigarette making equipment.

These and other objects are accomplished in the present invention through a two-stage method of depositing different blends and forming a continuous tobacco rod which can be cut at specified locations to form a multi-blend segmented cigarette. At a first stage, first portions of material such as a first blend of tobacco, reconstituted tobacco or tobacco substitutes, etc. are deposited at spaced intervals on the underside of a moving perforated belt, and are held in position on the belt by suction means. Deposition is accomplished by a transfer wheel means which forms the portions in predetermined amounts and at predetermined spaced intervals on the periphery of the transfer wheel through a pick-up mechanism which receives the material from a supply means such as a feed hopper or the like. At a second stage, a second tobacco blend which is different from the material contained in the first portions is deposited on the moving perforated belt in the gaps or intervals between the spaced first portion and surrounding and covering the first portions by an updraft chimney feeding system to form a narrower continuous layer of the second blend with discrete portions longitudinally spaced. The resulting combination of materials is trimmed to its final shape by removing a portion of only the second tobacco blend, placed in contact with a moving wrapper, and formed by a garniture device into a cylindrically-shaped continuous rod in which the second tobacco blend generally surrounds the first portions. The continuous cylindrically-shaped rod is cut between the discrete portions where only the second blend is located and within the discrete portions where the combined first and second blends are located to form a single cigarette length. When joining the single-length tobacco rod to a filter, the end having the combined blend is normally in contact or abuts the filter.

DESCRIPTION OF PREFERRED EMBODIMENTS

Figure 1:
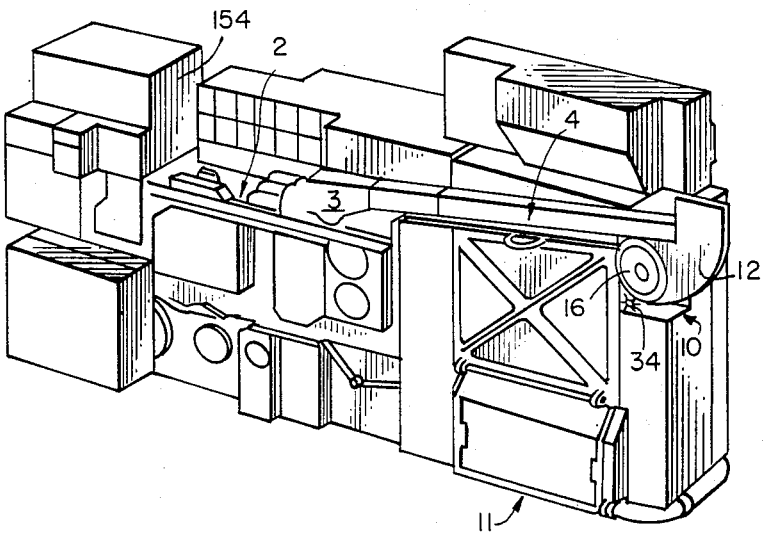
FIG. 1 is a perspective of a chimney-fed perforated belt cigarette making machine with a first embodiment of a multi-blend system according to the present invention.

Referring to the attached drawings, FIG. 1 illustrates a first embodiment of the multi-blend system 10 installed on a conventional updraft-type making machine 11, such as the Mark IX, produced by Molins Machine Company, Ltd., of Deptford, England. In an updraft-type cigarette making machine the tobacco travels upwardly in an updraft chimney 5 and is deposited on the underside of a moving, perforated belt assembly 4. As can be easily understood, any making machine which uses a perforated tobacco transporting belt and an updraft feed system can be used and only minor modifications to the system will be required to extend the belt so that the multi-blend system can be located at the end of the belt assembly prior to the chimney feed. When used herein a "cigarette making machine" generally denotes such a machine.

In subsequent processing stations (although not shown or described in detail herein), the tobacco rod is trimmed at 3, enclosed in cigarette wrapper paper 2, and cut into sections at 154 for further processing if desired. The multi-blend system must be in synchronization with the cigarette-making machine rod forming and cutting system to insure that the systems function properly as will be explained hereinafter.

Figure 2:
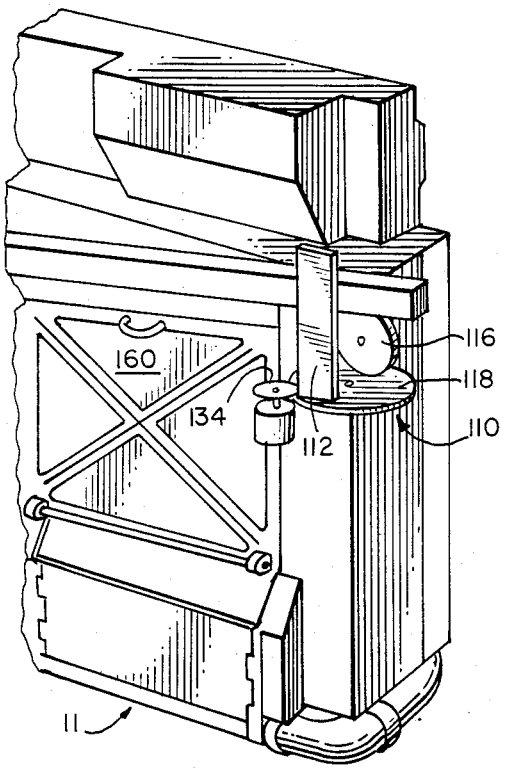
FIG. 2 is a perspective of a portion of a chimney-fed perforated belt cigarette-making machine with a alternate embodiment of a multi-blend system.

The multi-blend systems 10 and 110 are shown in FIGS. 1 and 2, respectively, positioned adjacent the underside of the perforated belt assembly 4, upstream of the updraft chimneys 5 and 160.

Figure 3:
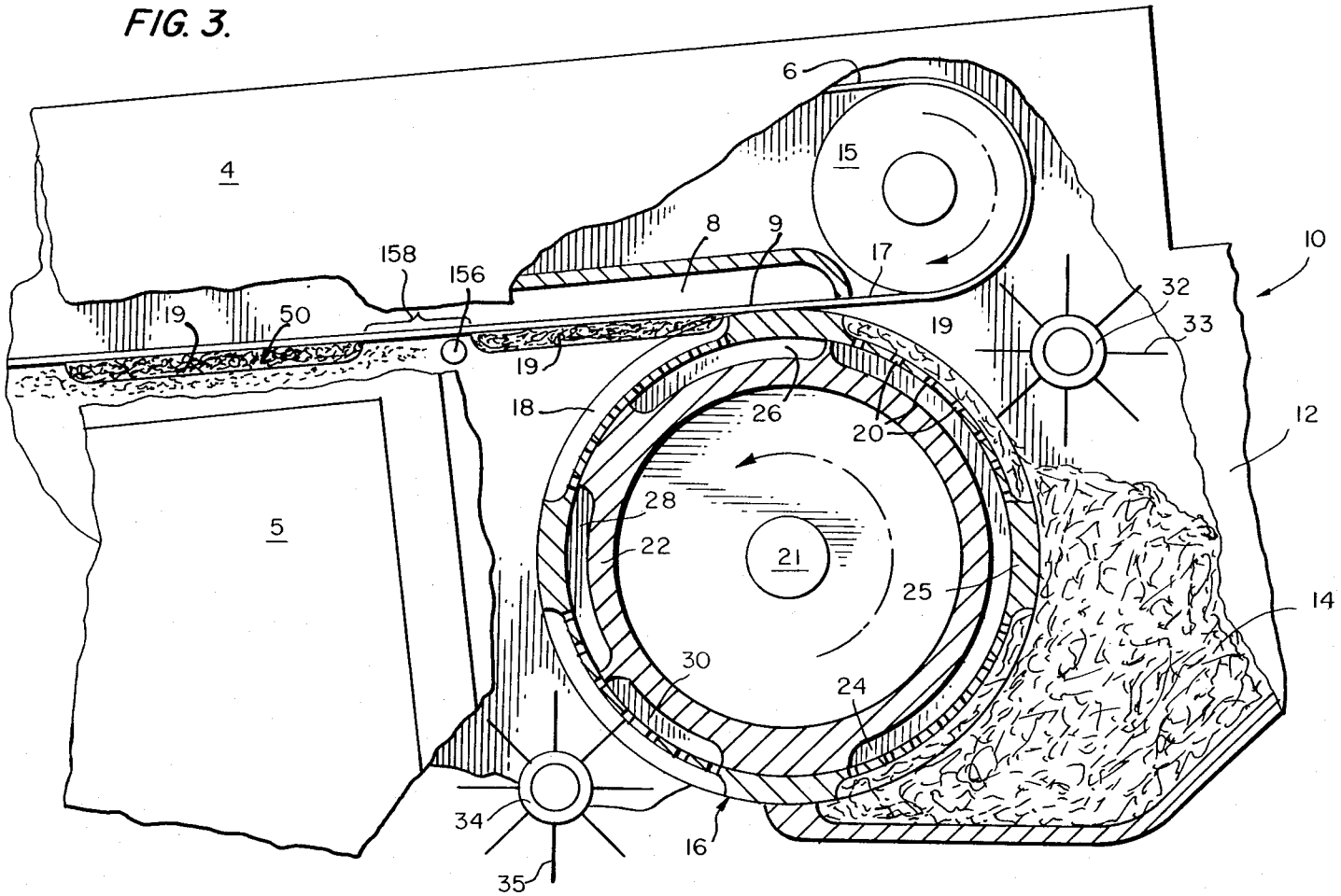
FIG. 3 is a section elevation view of the multi-blend system illustrating the transfer wheel and feed system utilized in the embodiment disclosed in FIG. 1.

In FIG. 3, numeral 12 indicates a hopper which contains a first or initial blend 14 which may be a pure tobacco blend, a tobacco substitute product such as that disclosed in U.S. Pat. No. 3,964,495, a reconstituted tobacco product, or a blend composed of two or more of these constituents. As used herein, "tobacco blend" or "blend" includes a single type of tobacco, a mixture of different types of tobacco, reconstituted tobacco, tobacco substitutes or a combination thereof.

The lower end of the hopper 12 is formed to receive and sufficiently enclose a portion of the transfer wheel 16 to prevent the escape of particles of the first blend. Although a hopper is utilized in this preferred embodiment to deliver the first blend to the transfer wheel, it should be understood that other methods can be used such as that illustrated in the alternate embodiment described herein, a separate chimney feed system or the like.

The transfer wheel is located directly below and contiguous to a continuous perforated belt 6, which travels in a clockwise direction around a driven pulley 15 as shown in FIG. 3. The width of the wheel will normally be at least as wide as the belt 6; however, the wheel width is not critical and is dependent on the chimney-feed for the production cigarette making-machine. A negative pressure or suction chamber 8 is located directly above the lower flight 9 of the perforated belt and provides suction or negative pressure to hold the material deposited against the underside 17 of the belt during formation of the tobacco rod. The transfer wheel can be positioned to be in direct contact with the belt, however, it is believed that a slight space existing between the periphery of the wheel and the perforated belt is desirable.

A plurality of pockets 18 are formed in the periphery surface of the transfer wheel. These pockets correspond to the desired shape of the first blend portion 19. Preferably, the formed portions are of such length that, when cut into single cigarette lengths, part of the portion will be contained in each cigarette, as hereinafter described. The ends of the pockets, however, should not describe sharp angles, to permit smooth transfer of the first blend portion 19 between the pocket and the perforated belt. The number of pockets is chosen commensurate with the size of the transfer wheel, which can be a matter of design preference based upon available space, the size of the hopper desired, and the rotational speed of the transfer wheel.

The transfer wheel is generally a hollow flat disc carried on a rotatable shaft 21 having a stationary ring 22 positioned and carried therein as is known in the art. The transfer wheel is rotated in a counterclockwise direction opposite to the direction of rotation of the belt 6. However, the periphery of the wheel travels in the same direction as the belt. The stationary ring has a negative pressure zone 24 located on the right half of the ring adjacent the hopper 12, a neutral pressure zone 26 located generally at the top of the ring, and a positive pressure zone 28 located on the lower portion of the left half of the ring prior to where the wheel enters the hopper. Ports 20 are provided through the wheel rim 25 within the pockets to permit communication between the pockets and the pressure zones.

Negative pressure zone 24 is coupled to a suction source, as is known in the art, so that material will be held within the pockets 18 as they pass through the hopper and over the negative pressure zone. Neutral pressure zone 26 is coupled either to ambient pressure or to a source of low positive pressure to assist the transfer of first blend portions from the transfer wheel to the perforated belt. Positive pressure zone 28 is coupled to a source of positive pressure, such as compressed air, to eject any tobacco particles which may remain in the pocket following transfer, clearing the ports before the pocket enters the hopper to receive subsequent deposits of material. An optional zone 30 may be added if desired and is coupled to a source of positive or negative pressure, as selected, to assist in clearing the ports.

Trimmer wheel 32, known in the art, is mounted adjacent the transfer wheel between the hopper 12 and the lower flight 9 of belt 6 so that trimmer blades 33 can engage the first blend portion 19 before the transfer wheel comes into contact with the perforated belt. The trimmer wheel 32 is connected to a power source which rotates it counter to the rotation of the transfer wheel. The clearance between transfer wheel 16 and the trimmer blades 33 is selected to remove excess material from the first blend portion 19 which is returned to the hopper 12. Cleaner wheel 34 is mounted adjacent the transfer wheel so that cleaner brushes 35 intersect the pockets 18 immediately prior to their entering the hopper. The cleaner brushes will normally be of resilient material and are dimensioned to make contact resiliently with the entire surface of the pockets. The cleaner wheel is coupled to a source of rotational power, not shown, and rotates counter to the transfer wheel.

As previously mentioned, the transfer wheel forms first blend portions 19 and deposits them on the moving perforated belt. As the transfer wheel rotates, a pocket 18 enters the hopper 12, coming into contact with the first blend 14. The pocket almost simultaneously enters negative pressure zone 24 so that the first blend is drawn into and held in the pocket as it advances into and through the hopper. The thickness of the material pick-up is greater than that required to form the first blend portion. As the transfer wheel continues to rotate, the first blend portion is held within the pocket by the continuation of the negative pressure and, immediately after leaving contact with the material within the hopper, trimmer blades 33 remove any excess of that required for the desired thickness of the first blend portion 19, kicking the excess back into the hopper. As rotation of the transfer wheel continues, the first blend portion 19 comes into contact with the underside 17 of the perforated belt. At this point, the pocket 18 leaves the negative pressure zone 24 and enters the neutral pressure zone 26; simultaneously, the first blend portion 19 is influenced by the suction applied to the perforated belt through suction chamber 8. The ambient pressure (or low positive pressure) of the neutral pressure zone 26 allows for fluid flow from that zone into the suction chamber, assisting in the transfer of the first blend portion to the perforated belt. Continued rotation of the transfer wheel, synchronized with movement of the perforated belt, results in smooth transfer of the entire first blend portion to the belt. After this transfer, the pocket enters the positive pressure zone 28, where compressed air removes any remaining material, assisted by the cleaner wheel 34 and, if desired, the optional pressure zone 30.

Figure 4:
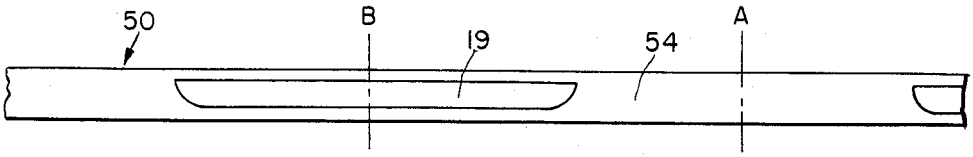
FIG. 4 is a section view of a continuous tobacco rod formed by utilizing the present invention illustrating the location of the various tobacco blends and the points at which the rod is cut.
Figure 5:
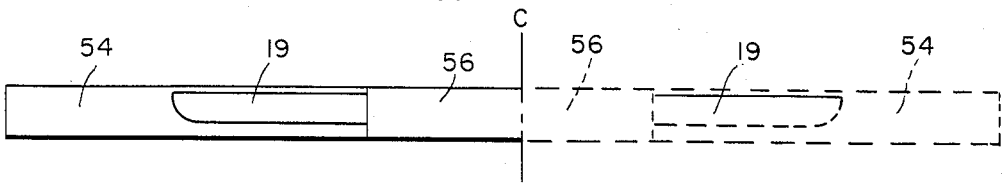
FIG. 5 is a section view of a filter cigarette with the combined blend segment adjacent the filter and the single blend segment at the unattached end and in phantom a two-up cigarette configuration.
Figure 6:
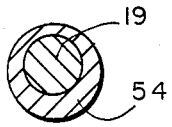
FIG. 6 is a cross-section taken along Line 6—6 of FIG. 4.

As the perforated belt 6 moves first blend portions 19 into the updraft chimney 5, a second or primary blend 54 is attracted to the perforated belt by action of the suction chamber 8 through the perforated belt, resulting in formation of the continuous rod 50, shown in FIGS. 3 through 6. As used herein, "second blend" means a tobacco blend which is different in some aspect of its content from the first blend portion. This rod comprises two discrete sections: the first blend portions 19, having the shape of the pockets 18, surrounded by second blend 54. Downstream of the updraft chimney 5, any excess of the second blend 54 only is trimmed away by the trimmer 3 and returned to the second blend feed system (not shown). The combined layer is fed off the perforated belt and into contact with a moving tape of cigarette paper, which is folded around the tobacco rod. This folding action results in part of the second blend being forced over the top of the first blend portion. The resulting cigarette rod has a cross section as shown in FIG. 6, with the first blend portions completely surrounded by the second blend. Although it is preferred to encapsulate the first blend portion in the second blend, it should be understood that the pocket and the belt can be so designed that the first portions are of such a size that the second blend will not completely encapsulate them. Furthermore, some of the material used in the first blend may be of such consistency and particulate size that they mix with the second blend slightly.

Downstream of the rod forming section 2, the tobacco rod is cut into individual cigarette lengths along lines A and B, shown in FIG. 4. It is desirable to space the cuts so that the cut along Line A is approximately centered in the gap between two first blend portions 19 whereby only the second blend is adjacent the cut. The cut along Line B is located at approximately the center of the first blend portion 19. This spacing of the cuts is possible through proper synchronization of the transfer wheel, perforated belt, and cutting means, using techniques known to the art whether the initial cutting is in a single- or double-length form. For example, this apparatus could be employed with density control equipment known in the art which detects different density and provides automated, feedback to control placement of the cuts.

On a filter cigarette making machine, individual cigarette lengths as defined between Cut Lines A and B are attached to a double-length filter plug 56 using tipping paper, and then cut on line C, as shown in FIG. 5. Using routine set-up procedures, the process can be arranged such that the end of each cigarette containing the combination of the first blend portion and second blend is placed closest to the filter plug. The result is a cigarette in which one end has only a single blend and a combination blend is consumed as the cigarette is smoked. This preferred embodiment of the multi-blend system functions to form the multi-blend segmented cigarette by providing a first blend of tobacco to an appropriate point adjacent to a tobacco conveying belt of a conventional cigarette making machine. A transfer wheel apparatus is utilized to form a plurality of spaced portions of the first blend and transferring the formed portions from the first blend supply to the conveyor belt, depositing the portions on said conveyor belt at spaced intervals. A second blend is delivered to the tobacco conveying belt and fills the gaps or intervals while also covering the formed portions to produce a multi-blend segmented layer. The multi-blend segmented layer is trimmed to remove only a portion of said second blend, thereby providing a layer of a uniformed thickness. The trimmed uniformed layer is transferred to a tobacco rod forming device which forms a continuously wrapped tobacco rod. The continuously wrapped rod is then cut in the interval between each of the portions and at approximately the midpoint of each portion to form single cigarette tobacco rods. A filter can also be attached to each single cigarette tobacco rod with the end of the tobacco rod having the combined first and second blends abutting the filter.

Figure 8:
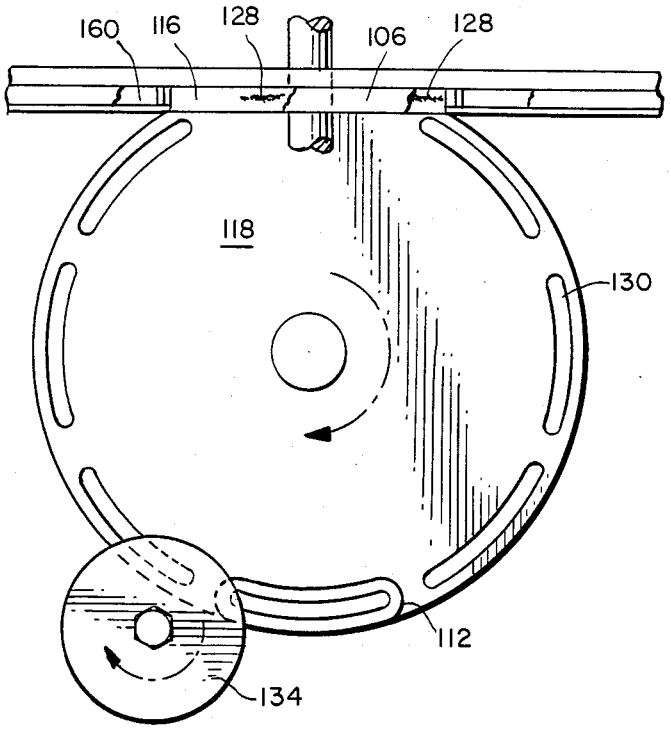
FIG. 8 is a top view of a suction collector and metering disc utilized in the alternate embodiment.
Figure 7:
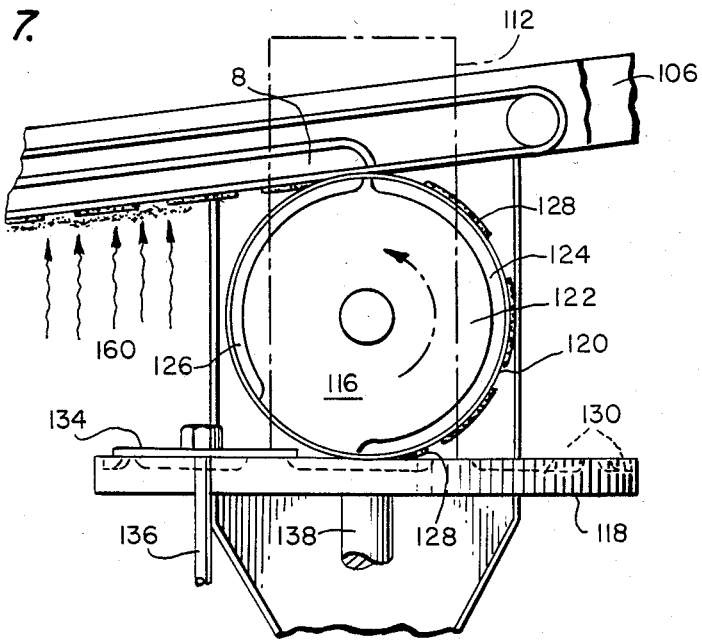
FIG. 7 is an elevation view illustrating a second embodiment of the multi-blend system as shown in FIG. 2.

An alternate embodiment of the multi-blend system 110 is shown in FIGS. 2, and 7 and 8. This embodiment will be mounted upstream of the updraft chimney 160, similar to system 10.

This embodiment differs principally in the transfer wheel 116 and in the means utilized to feed the first blend portions to the transfer wheel. A hopper (not shown) contains the first blend, and communicates with a feed chute 112. The feed chute is vertically mounted directly above a suction collector and metering disc 118, mounted at right angles to transfer wheel 116. The upper surface of the collector disc 118 contiguous to the peripheral edge is located directly below the peripheral edge of the transfer wheel 116 at a distance dictated by machine tolerances and other factors hereinafter discussed and is synchronized with the transfer wheel 116 such that the velocity of their respective perpheries is equal. As seen in FIGS. 7 and 8, the transfer wheel 116 rotates in a counterclockwise direction so that its peripheral edges are traveling in the same direction as the perforated belt 106, and the metering disc 118 rotates in a clockwise direction so that, at the point of contact of the two discs, the material is transferred from the metering disc 118 to the transfer wheel 116.

Transfer wheel 116 has a perforated peripherial edge 120 or a screen canvas similar to the perforated belt on a making machine and surrounds a stationary vacuum ring 122 having a negative pressure zone 124 and a positive pressure zone 126 similar to those discussed in connection with the first embodiment. The wheel is mounted and driven as is known in the art.

The transfer wheel is positioned at a slight distance from the perforated belt 106 based upon the amount of first blend portions 128 expected to be deposited on the perforated belt 106 before addition of the second blend. The upper face of the metering disc 118 carries collector pockets 130 disposed about its periphery which corresponds to the spacing of intervals required for the first blend portion on the perforated belt. The collector pockets are dimensioned to conform to the length and thickness of the first blend portion 128. The collector pockets communicate with suction means (not shown) which exert negative pressure on the first blend contained within the pockets. The suction means is operative in that portion of collector disc between the feed chute 112 and the transfer wheel 116. The mouth of the arced feed chute 112 adjacent the collector disc 118 is shaped to conform to the collector pockets.

A circular serrated knife 134 is mounted on a shaft 136 parallel to the collector disc shaft 138 in immediate counterclockwise position from the feed chute 112 and extends under the end of the chute between it and the collector disc. The knife 134 overlaps the collector pockets rotating in a direction opposite the collector disc to shear off the strands of material as the pocket passes from beneath the chute, thus, making the first portion to be deposited on the belt 106 generally equal to the size and shape of the pocket on the collector disc.

In operation, a collector disc 118 rotates under the feed chute 112, where particles of the first blend fill the pocket 130, held in place by the suction means. The pocket then rotates under the knife 134, where the strands are sheared off at the level of the upper surface of the collector disc. As the disc 118 continues to rotate, it carries the first portion under the transfer wheel 116. The transfer wheel and the collector disc are synchronized such that the first portion will be properly spaced on the transfer wheel and the belt 106. At this point suction is removed from the collector pocket, while the transfer wheel manifold applies suction to the transfer wheel negative pressure zone 124, resulting in transfer of the first blend portion 128 from the collector disc to the transfer wheel. The transfer wheel then carries the first blend portion to the perforated belt 106 and deposits it thereon, as described above. Manufacture of the finished cigarette proceeds as described above.

Figure 9:
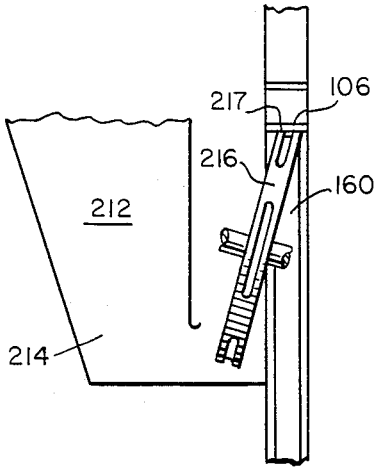
FIG. 9 is a modification to the embodiment illustrated in FIG. 1 showing a modified transfer wheel and hopper position.

A further alternative mounting arrangement is shown in FIG. 9 and is more easily employed in conjunction with the first embodiment. It would normally be used where space is a problem. Here, hopper 212 extends outwardly from the cigarette making machine, rather than as shown in FIG. 1. Transfer wheel 216 is mounted at an angle to the side of the cigarette making machine, rather than parallel to it. The end of the transfer wheel extending outwardly from the cigarette making machine is received into the mouth of hopper 212. The edges of the transfer wheel are beveled such that when mounted, the upper edge 217 is parallel to the perforated belt.

Otherwise, the operation of this embodiment is exactly the same as described above: first blend 214 is picked up by the transfer wheel pockets, excess tobacco is trimmed, and first blend portions are deposited on the transfer belt.

Figure 10:
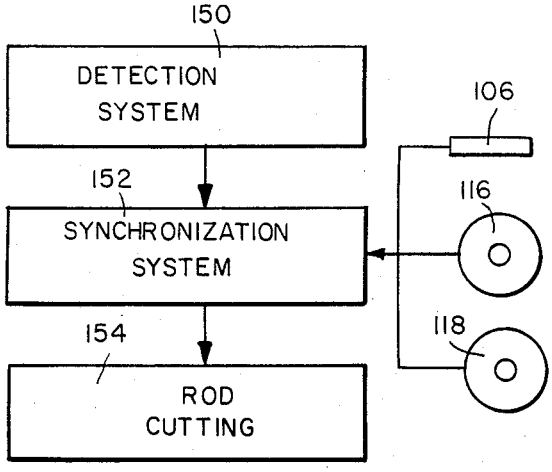
FIG. 10 illustrates a schematic diagram of one detection and synchronization system according to the present invention.

FIG. 10 illustrates a block diagram of a simplified detection device 150 and synchronization mechanism 152 which can be a gearing mechanism or the like as is known in the art and not only synchronizes the perforated belt 6 or 106, the transfer wheel 16 or 116, and in the case of the alternate embodiment, the collector 118, to cause the first portion to be placed on the correction location on the belt, but also synchronizes the rod cutting mechanism 154 to insure that the continuous rod is cut at the appropriate position as described above. A sensor 156 for the detection device can be located adjacent the belt 6 just before the belt enters the chimney 5 (see FIG. 3) to detect the gaps 158 between the first portion 19 carried on the belts.

As will be apparent to those skilled in the art, there are many variations and changes that can be made to the apparatus and method defined hereinabove without departing from the invention described. For example, the feed system for the first blend can be varied, the different detection systems can be used, etc., however, variations and changes of this nature can be made to the above-described and illustration invention without departing from the true spirit and scope thereof as defined in the following claims.

What is claimed is:

1. A cigarette-making machine for producing a multi-blend segmented cigarette comprising:

(a) means for conveying tobacco defining a tobacco receiving surface;

(b) means for retaining said tobacco on said tobacco conveying means;

(c) first blend supply means for supplying a first blend adjacent said tobacco conveying means;

(d) forming means adjacent to said tobacco conveying means for receiving and forming portions of said first blend at spaced intervals and transporting said formed portions into contact with said tobacco conveying means;

(e) means for retaining said formed portions on said and forming means between said first blend supply means and said tobacco conveying means and transferring said formed portions to said tobacco conveying means;

(f) second blend supply means located adjacent said tobacco conveying means and subsequent to said forming means for supplying a second blend to said tobacco conveying means, said second blend being deposited on said tobacco conveying means in the spaced intervals between said formed portions and covering said formed portions carried on said tobacco conveying means to form a longitudinal layer of said second blend having discrete portions of said first blend at spaced intervals therein;

(g) means for trimming said longitudinal layer to form a trimmed layer of uniform thickness by removing only portions of the second blend;

(h) rod-forming means for receiving said trimmed layer and forming a tobacco rod with a wrapper;

(i) cutter means for cutting said wrapped tobacco rod into segments; and (j) control means for synchronizing said cutter means with said rod conveying means to cut the tobacco rod in the intervals between each portion including a sensing device located adjacent to said tobacco conveying means subsequent to the transfer of said portions to said tobacco conveying means and prior to said second blend supply means for detecting the location of each formed portion on said tobacco conveying means.

* * * * *